United States Patent [19]

Krietemeier et al.

[11] Patent Number: 4,763,928

[45] Date of Patent: Aug. 16, 1988

[54] METHOD AND APPARATUS FOR THEFT IDENTIFICATION OF EQUIPMENT

[75] Inventors: Rickie F. Krietemeier; Jeffrey A. Strom, both of Englewood; Richard A. Stonich, Denver, all of Colo.

[73] Assignee: Equipment Identification Systems, Inc., Denver, Colo.

[21] Appl. No.: 86,286

[22] Filed: Aug. 17, 1987

Related U.S. Application Data

[63] Continuation-in-part of Ser. No. 779,080, Sep. 23, 1985, abandoned.

[51] Int. Cl.[4] ..... B42D 15/00

[52] U.S. Cl. ..... 283/70; 283/75; 283/76

[58] Field of Search ..... 283/70, 72, 73, 74, 283/75, 81, 76

[56] References Cited

U.S. PATENT DOCUMENTS

| | | | |
|---|---|---|---|
| 3,665,918 | 5/1972 | Lindquist | 128/156 |
| 3,752,960 | 8/1973 | Walton | 235/61.11 H |
| 3,803,571 | 4/1974 | Luz | 340/258 C |
| 3,898,619 | 8/1975 | Carsten et al. | 340/152 |
| 4,129,855 | 12/1978 | Rodrian | 340/152 T |
| 4,168,586 | 9/1979 | Samis | 283/70 |
| 4,208,795 | 6/1980 | Mühlemann et al. | 283/70 X |
| 4,239,261 | 12/1980 | Richardson | 283/74 |
| 4,243,734 | 1/1981 | Dillon | 283/70 X |
| 4,247,758 | 1/1981 | Rodrian | 235/92 MS |
| 4,506,914 | 3/1985 | Gobeli | 283/70 |
| 4,535,557 | 8/1985 | Porcher | 283/74 X |

*Primary Examiner*—Paul A. Bell

*Attorney, Agent, or Firm*—John E. Reilly

[57] ABSTRACT

A method and apparatus for theft identification of articles, such as, machines and equipment employs one or more miniature, coded portions or disks, each disk in the form of a thin film bearing preassigned data which is photo optically reduced on the film so as not to be readable with the naked eye, and at least partially severed from the film so as to facilitate application to an article. The disks may be placed on or buried in the articles at different locations known only to the owners as well as being placed at other random locations and are composed of a material not discernible by remote locating means thereby making it virtually impossible for unauthorized persons to locate and remove the disks from the equipment.

10 Claims, 2 Drawing Sheets

METHOD AND APPARATUS FOR THEFT IDENTIFICATION OF EQUIPMENT

CROSS-REFERENCE TO RELATED APPLICATIONS

This application is a continuation-in-part of Ser. No. 779,080, filed 23 September, 1985 for METHOD AND APPARATUS FOR THEFT IDENTIFICATION OF EQUIPMENT now abandoned.

Specification

This invention relates to theft identification systems, and more particularly relates to a novel and improved method and apparatus for the coding and identification of various articles, such as, machines and equipment for theft identification purposes in the event of loss or theft in a simple but highly reliable and foolproof manner.

BACKGROUND AND FIELD OF THE INVENTION

It is customary to employ tags or pellets which are embedded in an object for the purpose of subsequent identification. For instance, in the case of animals, tags are attached to the skin or subcutaneously and contain some form of a passive circuit which can be inductively coupled or electromagnetically sensed and read into a computer along with other data concerning the condition of the animal.

In protecting articles against theft, similar approaches have been devised to those of animal identification where, for instance, an article can be recognized or identified by matching of a coded object containing a passive circuit with some form of remote sensor or detector. For example, U.S. Pat. No. 3,752,960 to Walton is representative of this approach. Another approach is typified by U.S. Pat. No. 4,309,904 to W. R. Jones et al in which pellets of different thicknesses are embedded in the article and can be ultrasonically sensed. This requires utilization of pellets of different known thicknesses where the thicknesses are selected to represent a specific code or means of identification for that article. U.S. Pat. No. 4,208,795 to H. R. Muhlemann et al discloses implantation of an, information carrier into a cavity and the covering of that carrier and cavity with a visually distinguishable filler. U.S. Pat. No. 4,239,261 to R. H. Richardson is directed more to application of a transparent seal over a micro-marking label which is applied to an article for identification. There the label is placed upon the surface of the article to be identified and secured thereto by the sealant but is visible to the naked eye on close inspection and can be readily removed. U.S. Pat. No. 4,168,586 to P. L. Samis is similar to Muhlemann et al in that it discloses a marker embedded in a cavity and which can be located by means of radiography. However, it is extremely desirable in identification systems to employ a series of markers or portions in the form of microdots which can be rapidly but securely placed at one or more locations on the surface of an article to be identified and in such a way as to be substantially invisible to the naked eye but identifiable by one knowing the locations of the markers. In this way, it is possible to obviate the use of remote sensors or detectors because of the inherent danger that the one stealing the equipment could use such remote means of detection to ascertain the location of the coded marker and remove same along with any other means of identification on the article or equipment. Moreover, it is desirable to provide a method and means of identification which are relatively inexpensive and easy to install thereby facilitating installation at a number of preassigned locations and other random locations if desired and can be completely concealed from view.

SUMMARY OF THE INVENTION

Accordingly an object of the present invention is to provide for a novel and improved method and apparatus for identifying articles in a foolproof and reliable manner.

It is another object of the present invention to provide a novel and improved method and apparatus for identification of lost or stolen articles which makes location of the articles virtually impossible to unauthorized persons, but to those equipped with the knowledge of their location can be easily removed and identified to establish ownership of the article in the event of loss or theft.

It is a further object of the present invention to provide for a novel and improved system in which the necessary coding and identification of an article is placed in photo optically reduced form on an inert miniature disk or portion of microfilm and applied to an article situated not to be readable or otherwise discernible to the naked eye and further is not locatable with the aid of remote sensing devices; and further wherein novel and improved method and means are provided for application of each disk securely to the article in a rapid, efficient manner.

In accordance with the present invention, there has been devised apparatus for identifying the owner of an article comprising a transparent sheet of microfilm having a series of owner-identifying, coded data imprinted on portions of the shee in photographically reduced form which is discernible only by magnification of the data with a magnifier, and securing means for removably securing the portions to an article to be identified, the securing means defined by an adhesive and a backing member removably applied over said adhesive. The microfilm sheet is severed into rows. Similarly, each portion is completely or at least partially severed from the microfilm sheet without penetrating through the backing member. In this way, in surface mounting a series of portions, a strip or row of portions can be removed from the backing member and an applicator rod having an end portion substantially corresponding to the size of each portion is used to press each portion against the surface of the article at different preselected locations. By the simple expedient of separating or removing the strip away each portion as pressure is being applied to the portion avoids tedious and time-consuming manual separation and application of each portion. In subsurface mounting, both the portion with the reduced image and white backing member may be severed from the sheet and placed in a container. The container is then inserted into an opening in the article and covered with an outer protective cap.

Both in the surface mounting and subsurface mounting processes, the information pertaining to the location and coded data is furnished only to the owner or authorized representative for purposes of subsequent identification in case of loss or theft. Should it become necessary to identify the owner of an article, where the portions are surface mounted at preassigned or random locations, one of those portions is removed and placed on a white background and read with a microfilm reader or microscope for purposes of matching with the recorded data identifying the owner of the article. In the case of subsurface mounted portions, one of the portions at a preassigned location is exposed and may be read in the same manner without removing the container from the article.

In an alternate method for preparing a film sheet containing rows of data, the identifying information which is to appear on each portion is stored in digital form and is transferred to magnetic tape; it is then converted back into human readable or alphanumeric characters and displayed on a screen; that information which appears on the screen is formatted into a series of images and photographically reduced to a series of micro-sized dots or disks onto a microfilm sheet; the microfilm is then processed, and a backing member adhesively secured to the back of the sheet; the micro-sized dots are then punched or at least partially severed from the sheet but without removal from the backing member, and the sheet is preferably divided into a series of strips or rows of microdots. In order to apply to an article to be identified, a strip or row of microdots is removed from the backing member and applied by means of an applicator rod at spaced locations to the article to be identified in the manner previously described.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
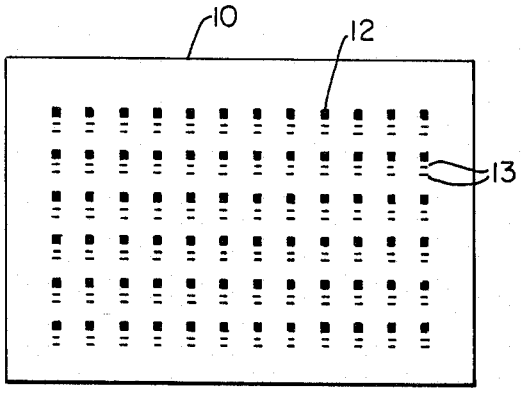
FIG. 1 is a plan view illustrating a series of coded disks formed on a sheet of microfilm in accordance with the present invention.
Figure 2:
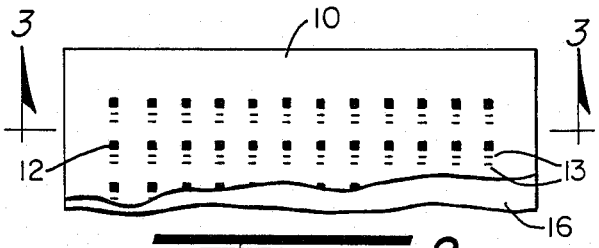
FIG. 2 is a fragmentary plan view illustrating an alternate method of forming a sheet containing a series of coded disks.
Figure 3:
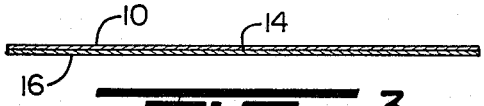
FIG. 3 is a cross-sectional view taken about lines 3—3 of FIG. 2.

Referring to the drawings, there is illustrated in FIGS. 1 to 3 a sheet of microfilm 10 upon which is imprinted a series of micro-identifiers 12 and a pair of locating marks 13 located immediately beneath each micro-identifier 12 for a purpose to be hereinafter described. An adhesive substance as represented at 14 is applied to the reverse or opposite surface to that which bears the imprinted micro-identifiers, and a white backing sheet 16 is in turn applied over the adhesive surface 14, the white backing sheet 16 being selectively removable from the adhesive and microfilm sheet 10.

Figure 5:
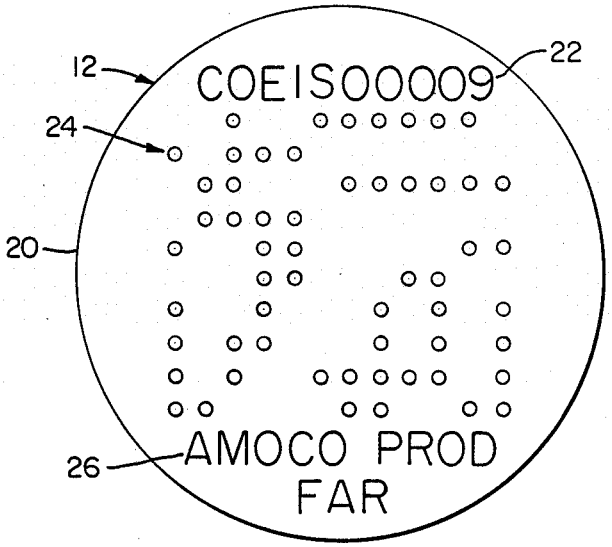
FIG. 5 is an enlarged view illustrating a typical disk and coded information thereon.

Considering in more detail the preferred form of micro-identifier, as best seen from FIG. 5, each micro-identifier 12 takes the form of a circular strip or disk 20 which is formed out of the sheet of microfilm 10 in a manner to be described. Imprinted upon each disk 20 is an owner serial number as represented at 22, a pattern of dots generally designated at 24 and the name of the owner as designated at 26. It should be understood that the foregoing is by way of illustration and not limitation and that the owner-identifying coded data may consist of any one of the serial number 22, dot pattern 24 or owner's name 26 or a selected combination of same. The pattern of dots is particularly effective in that it can be microfilmed or otherwise reduced to microscopic size and which is readable with a high power microscope on the order of 30×. In this way, not only is the coded data not readable with the naked eye but enables imprinting within a very small space or area. For example, each micro-identifier 12 may have a diameter on the order of 5/64" and a thickness on the order of several mils. Preferably, the adhesive 14 is a polyester carrier with rubber-based bonding agent applied to each side of the carrier so that it will adhere both to the reverse side of the micro-identifier and to the white backing sheet 16 to make the image more visible on the film for the purpose of cutting out with a hand punch. Preferably, the white backing sheet 16 is a tough plastic laminate or fabric reinforced plastic laminate which is resistant to tearing or cutting. On the other hand, the microfilm sheet 10 is composed of a conventional transparent film material, such as, silver halide which is relatively inflexible but more susceptible to cutting or tearing by a knife edge or blade than the backing material 14.

In order to remove each disk 20 from the microfilm sheet for purposes of installation on or in an article to be identified, a conventional platen press may be employed which, for example, will sever each micro-identifier or disk from the microfilm sheet by locating the press punches over the sheet and superimposing the punches on the press over the micro-identifiers to be severed. When activated, the press will sever the disks 20 out of the microfilm sheet but without penetrating through the white backing member. In this way, the disk is severed and removed from the microfilm sheet together with the adhesive surface 14 without disturbing the white backing member, and the disk is then ready for immediate application to the article to be identified.

In the preferred embodiment, the micro-identifiers 12 as illustrated in FIGS. 1 and 2 contain owner-identifying encoded data identical to one another and which are placed or evenly spaced in rows along the sheet by forming an image of the desired information and, using a film positive, the image is then reproduced by micro-printing as a positive image a succession of times in a conventional step repeat process on the silver halide film to form the rows of identifiers 12 as shown. Preferably, the images are spaced to within 0.003" tolerance so as to permit accurate severance of the disks by the press with the information centered in each disk.

Once severed, the micro-identifiers 12 define strips which are installed on the surface of the article to be identified preferably with the use of a pair of miniature tweezers, such as, conventional watch repair tweezers.

The identifier may be placed at spaced locations directly onto the surface of the article and by virtue of their miniature size and transparency do not require any special means of concealment. Installation of the disk is so rapid and effective that the disk may be placed in any number of locations on the equipment including preassigned locations as well as random locations. If desired, the disk can be covered with a concealing substance, such as, paint which matches the surface of the article, and selected of the disks may be covered with an invisible ultraviolet metal marking ink to permit discovery with any ultraviolet long wave source. In those specified locations, persons other than the owner may by remote sensing ascertain the location of one or more of the ultraviolet-covered disks for purposes of identifying the owner of the article. Most typically, however, when an article suspected of having been stolen is found, the law enforcement officials will then contact the owner for the preassigned locations of the disk for purposes of removal and identification. Additional random locations may be employed only in the unlikely event that the thief should discover the preassigned locations of the disk and remove same in an effort to thwart proper identification.

As a means of subsequent identification, information containing the assigned location of the disk and the owner-identifying coded data is placed only in the hands of the owner or designated representative with further information bearing the type of equipment, manufacturer, model number and serial number. Thus, in the event of loss or theft, the owner or designated representative must be contacted to ascertain the location and information bearing the code for that piece of equipment. The owner or representative must then disclose same to law enforcement officials for the purpose of identification.

Once the location is known, the disk at any given location is removed by scraping off of the surface of the article, laying it on a white background and placing under a microscope, such as, a 30-power lighted portable microscope; or, in certain cases, the information can be read directly off of the film using a microscope without removal of the film or identifier from the equipment. Generally, if the identifier 12 is placed on a white background it is easily readable with the aid of a microscope, once the location is known. By way of illustration, surface-mounted identifiers may be employed in identifying articles, such as, office equipment, furniture, guns, light industrial equipment and jewelry. The identifiers are of such a size that they can be applied to a flat surface, grooves or to the ends of bolts or screws without being discernible to the naked eye.

Figure 4:
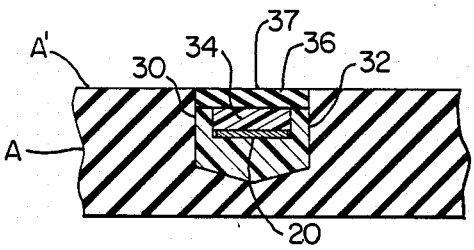
FIG.4 is a cross-sectional view enlarged illustrating subsurface mounting of a disk in an article to be indentified.

FIG. 4 illustrates the subsurface mounting of a micro disk or strip 20 in an article to be identified. In FIG. 4, each disk or strip 20 is inserted in a shallow generally cup-shaped vial or capsule 30 which is inserted into an opening 32 formed in the article. The film strip 20 is retained within the hollow cavity of the capsule 30 by a protective cap 34 inserted over the film and into the cavity so as to cover and effectively encapsulate the film within the vial. The assembled capsule 30, film strip 20 and cap 34 are then fully inserted into the opening and covered by an outer concealing cap 36 which is of a thickness to fill the remaining space in the opening not occupied by the capsule so that external surface 37 of the cover 36 is mounted flush with external surface A' of the article A.

The micro-identifiers 12 are formed on a sheet of microfilm 10 for the purpose of subsurface mounting as illustrated in FIG. 4 in the same manner as shown and described with respect to FIGS. 1 to 3 and 5 but slightly larger. Again, therefore, the image is microprinted by using a film positive with a slightly larger image and may be reproduced as much as 300 to 325 times on silver halide film. An adhesive is applied to the reverse side followed by a white backing member 16. Each micro-identifier 12 is then cut out by a hand punch; however, in subsurface mounting, the punch may sever completely through the backing member so that the resultant disk 20 with attached backing member may be placed in the capsule 30 with the backing member beneath the film. Preferably, the vial or capsule 30 as well as the protective cap 34 is composed of an inert material, such as, a clear, durable resin material capable of withstanding caustic baths and temperature extremes of −60° F. to +270° F.

In a typical installation of the capsule assembly, a ¼" diameter hole is drilled into the surface of a piece of equipment to a depth of approximately ⅜". The protective cap preferably is pressfit into the vial capsule as to seal the disk 20 therein. This may be done by making the cap slightly oversized and, prior to insertion into the capsule, placing in Freon so as to temporarily shrink it and allow for ease of insertion into the capsule. The cap will then expand as it returns to normal temperature to tightly seal the disk 20 in place. The assembled capsule and cap are then inserted into the opening with the identifying code facing upwardly so as to facilitate subsequent identification when needed. The remainder of the opening is covered with a stainless steel cap placed on top of the capsule so as to be flush with the surface of the article as hereinbefore described. Again, the outer cap 36 preferably is composed of any material which matches that of the article itself followed by painting or otherwise applying a concealing substance.

In subsurface mounting of the capsule assemblies, any number may be embedded in the article at one or more preassigned locations as well as several random locations. The same information concerning location and information bearing code is recorded and retained by the owner or designated representative for subsequent identification in the event of loss or theft.

When desired or necessary to identify a piece of equipment, the concealing substance is removed from the metal cap 36 and the cap removed from the hole by prying it off with a suitable instrument or tool. The information then can be read in place with a microscope, such as, a 30-power lighted portable microscope. Subsurface mounting of the identifiers as described is especially adaptable for use in identifying heavy equipment as well as smaller articles where desired.

Figure 6:
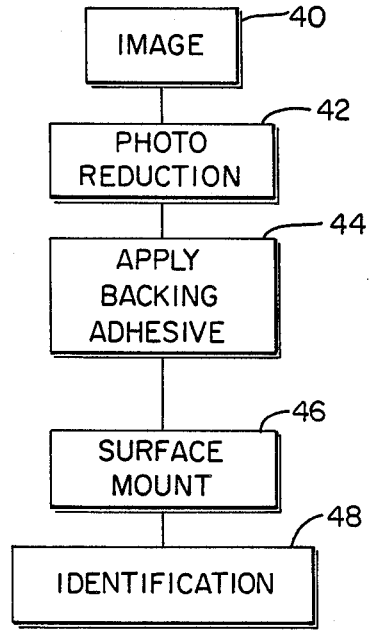
FIG. 6 is a schematic view illustrating the method of preparation and installation of surface mounting.

Briefly summarizing the metho followed in surface mounting of microfilm strips for the purpose of identifying the owner of an article, FIG. 6 illustrates the sequence of steps comprising the forming of an image 40 containing owner identifying coded data and microprinting the image a succession of times to reproduce it onto a microfilm sheet as designated at 42. A backing member is applied along with an adhesive as represented at 44 to the microfilm sheet. In the surface mounting of identifiers as represented at 46, each sheet is divided into microfilm strips preferably by severing a strip or disk containing an image of the coded data from the microfilm sheet and removing it both from the microfilm sheet and backing member following which it is applied to the surface of an article to be marked. The location of each strip secured to a preassigned location and the coded data on each strip are recorded for purposes of subsequent identification known only to the owner of the article as represented at 48. Subsequently, one of the strips is removed from the article and any concealing substance removed from the strip when desired to identify the article, as designated at 50, and the identifying coded data on the strip is magnified for purposes of matching with the recorded data identifying the owner of such article. The invention is further characterized by imprinting a series of identifying coded data on a sheet of microfilm and applying an adhesive substance to the sheet and covering the adhesive substance with a removable backing member. The sheet is divided into a plurality of strips as defined by removing from the backing member and adhesively securing the strip to the article.

Figure 7:
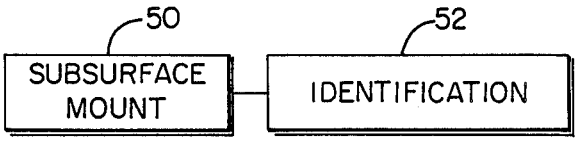
FIG. 7 is a schematic view illustrating the method of preparation of disks and subsurface mounting thereof.

The method of subsurface mounting as illustrated in FIG. 7 utilizes the above steps 40, 42 and 44 and in addition is characterized by placing the strip in a container, embedding the container and strip in an opening formed in the article, as represented at 50, and covering the remainder of the opening not occupied by the container with an outer protective cap. The outer cap is removed when necessary to identify the article, as designated at 52. The container may be left in the opening and the coded data on the strip is magnified for the purpose of identifying the article.

DESCRIPTION OF ALTERNATE FORMS OF INVENTION

Figure 8:
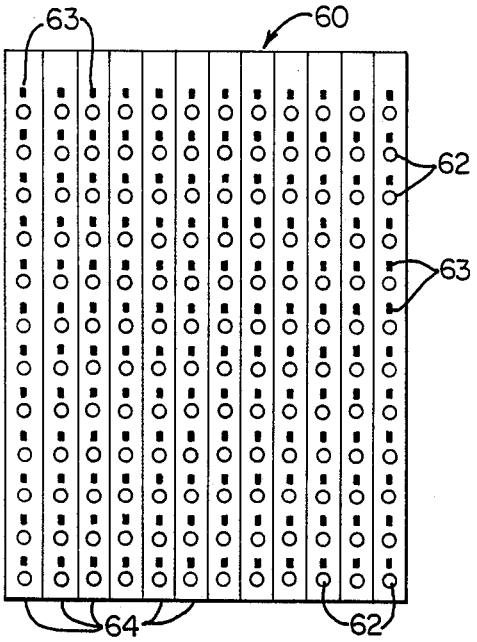
FIG. 8 is a plan view illustrating a modified form of invention in which a series of coded disks are arranged in rows on a microfilm sheet.
Figure 9:
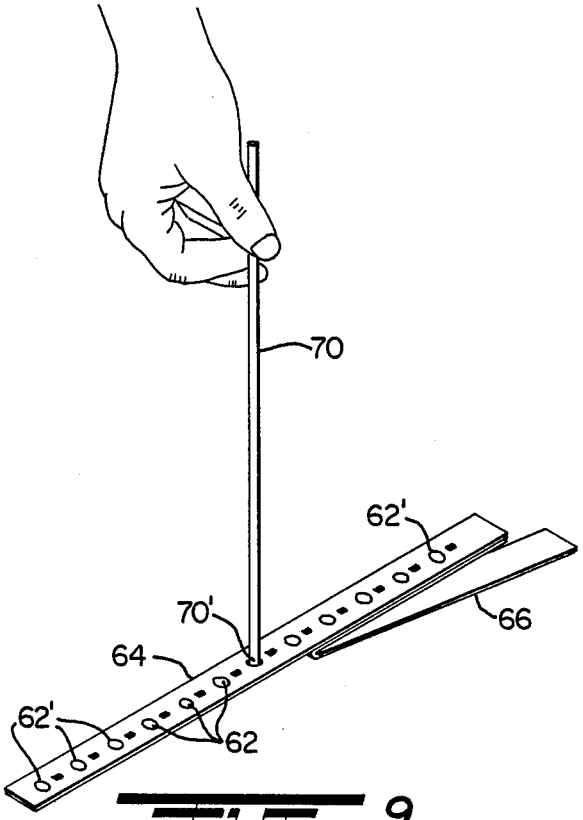
FIG. 9 is a somewhat perspective view illustrating the method of applying each disk to an article to be identified.

There is illustrated in FIGS. 8 and 9 an alternate form of microfilm sheet 60 containing a series of micro-sized dots 62 and a locating marker 63 immediately above each dot 62 in order to facilitate punching or severance of each dot from the sheet in the manner described with respect to FIGS. 1 to 7. The micro-sized dots or portions 62 are arranged in rows and which rows are severed into a series of strips 64 in a manner to be described. An adhesive backing member 66 is applied to the back or reverse side of the sheet which bears the identifying information on each microdot or portion 62, so as to be selectively removable from the microfilm sheet 60. Although not shown, the adhesive substance between the sheet 60 and backing member 66 also corresponds to that described in FIGS. 1 to 7 and is one which will adhere both to the reverse side of the sheet and the backing member. Correspondingly, the white backing member 66 will make the identifying information on each dot 62 more visible for the purpose of cutting or severance from the film sheet.

Imprinted upon each dot or portion 62 is the necessary owner-identifying coded data which may consist of alphanumeric characters, a pattern of dots or coded information, or a combination of same but which is photographically reduced to microscopic size. When placed on a dot 62 having a diameter on the order of 5/64" and a thickness on the order of several mils, the entire dot is not discernible either by sight or touch without knowing its precise location.

An important feature of the alternate method and apparatus as shown in FIGS. 8 and 9 resides in the construction and arrangement of the microfilm sheet 60 into the rows of identifier strips 64 so as to greatly facilitate application of the individual identifier dots 62. Once the microfilm sheet has been prepared and assembled together with a backing member, each dot 62 is at least partially severed from the microfilm sheet for purposes of subsequent installation on the article to be identified by means of a conventional platen press as described with reference to FIGS. 1 to 7. A typical form of punch press is the Kenco Press manufactured and sold by Teledyne Tabor of North Tonawanda, New York. Briefly, the press will sever the entire circumference of the portion or dot 62 from the microfilm sheet 60 without penetrating through or cutting the backing member 66; or in the alternative each portion or dot may be partially severed to leave a minor or limited arc 62' united with the sheet as shown in FIG. 9. A conventional form of cutter is then employed to sever the sheet into rows or strips 64, each strip containing a series of dots 62. Depending upon user preference, the microfilm sheet 60 along with the backing member 66 may be severed into separate rows or strips, or if desired only the sheet need be cut or severed without cutting the backing member. As best seen from FIG. 9, the backing 66 has been left intact behind a single row 64 of the microdots 62. In order to apply each microdot or disk 62 to the equipment or article to be identified, an applicator rod 70 is provided having an end portion 70' which is of a diameter corresponding to that of a dot 62. By placing the strip 64 alongside the equipment or article to be marked with a selected dot 62 contacting the surface of the article at a specified location, the end of the applicator rod 70 is pressed against the dot 62 and the rest of the strip is separated or severed from the monor arc 62' and withdrawn away from the article, leaving the selected dot 62 in place. By progressively removing the backing member to expose a each dot portion 62, a plurality of portions 62 may be installed at different specified or desired locations on the article. Again, because of the size and transparency of the image contained on each portion 62, it is not visible to the naked eye, and the film is so thin that it is virtually impossible to locate merely by rubbing or passing the hand across the surface containing the portion dot or disk portion 62 so as to assure complete adhesion to the surface. The applicator rod 70 avoids any direct contact with the adhesive and permits direct application of pressure against the portion 62 so as to assure complete adhesion to the surface. This method of installation greatly facilitates rapid, effective placement of the portions 62 at a number of locations on the equipment, and those locations are noted and made available to the owner of the equipment for subsequent identification purposes.

In case of loss or theft of the article, once recovered, the owner or designated representative is contacted to ascertain the location and information bearing the code for that article. Once the location is known, a selected portion 62 may be removed by scraping or peeling off of the article, laying it on a white background and placing under a microscope, such as, a 30-X lighted portable microscope. In certain cases, the information can be read directly from the dot using a portable microscope without removal of the dot from the equipment.

Figure 10:
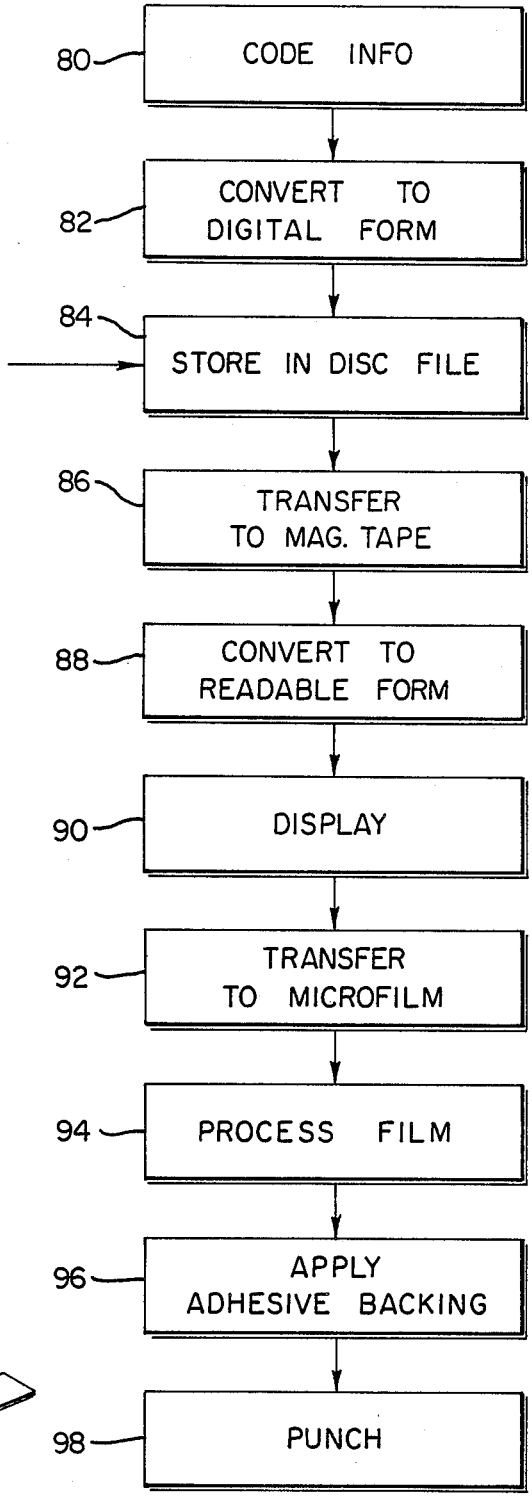
FIG. 10 is a schematic view of an alternate method of preparation of the micro-sized disks for application to an article to be identified.

An alternative method of preparing the microdots 62 and placing on film is illustrated in FIG. 10 wherein the information which is to be placed one each identifier or disk 62 is first coded as represented at 80 as described with reference to FIGS. 1 to 7. The code or series of codes is converted from a written or typed character into a digital representation of the character or characters as at 82. Other information associated with the digital representation, such as, name, address, social security number, is also digitized and written out to a disk file as at 84 for further manipulation or subsequent access when desired. The information as stored at 84 is then transferred or output as at 86 to a magnetic tape in any suitable abbreviated form. This tape will be used to create the micro images on film which become the microdots or disks 62. The records are left on the disk file as at 84 for future identification and information about a particular code; also, it provides a link to the user of the microdot or disk 62 and the unique code. The abbreviated information on tape which is in digital form is converted into alphanumeric characters, or a human readable series of characters, which identify the unique code as indicated at 88. The data as it is read off of magnetic tape and converted is then reformatted and displayed on a small cathode ray tube as indicated at 90. The display is then formatted and photographically reproduced into a series of images as well as being photographically reduced and transferred onto microfilm as at 92, following which the microfilm is processed so that it can be exposed to normal light conditions and handling, as indicated at 94. Once the film has been processed it is advanced through the steps as earlier described of the adhesive backing member application as at 96, punching of the disks 62 as at 98 and cutting into individual rows. It is to be noted that the images are transferred onto the same surface of the sheet 60 as the backing member 66 so a to be protected by the backing member 66, but are readable through the opposite surface of the sheet. For the purpose of illustration, silver acetate film may be employed as the microfilm media and this film may be processed using a black and white silver film processor. As an alternative to partial severance of each portion 62 as described, each portion may be completely severed or perforated around its periphery to achieve the same end.

Although forming no part of the present invention, it will be evident that where information is to be retained concerning numerous articles or items of equipment including locations, model numbers, etc. such lends itself particularly well to encoding into a computer, followed by information retrieval from the computer when desired. This is especially so in the case of identification services which would maintain such information for a number of customers and requires speedy access to information concerning a given piece of equipment. It will be apparent that the transparency of the sheet with respect to the images may be the reverse of that described so that the microfilm sheet is a film negative, or black, and the images are clear or transparent. It is therefore to be understood that the above and other modifications and changes may be resorted to without departing from the spirit and scope of the present invention as defined by the appended claims.

We claim:

1. The method for identifying the owner of an article in the event of loss of the article comprising the steps of:

(1) microprinting a series of images containing identifying coded data on one surface of a thin sheet of microfilm, said data identifying the owner of said article, said images being invisible to the naked eye when removed from said sheet and applied to the source of an article to be identified:

(2) applying an adhesive substance and backing member to a surface of said sheet;

(3) at least partially severing a portion of said sheet containing each said image from said sheet without severing said backing member so that each said portion severed remains intact with said sheet on said backing member;

(4) removing said backing member from each said portion and adhesively securing each said portion at different locations on said article by pressing the surface of each said portion having said adhesive substance into contact with said article; and (5) recording the location of at least selected of said portions attached to said article.

2. The method according to claim 1 characterized in step (1) by microprinting a series of said images of identifying coded data on a sheet of microfilm and, following steps (2) and (3), separating said sheet into a plurality of strips, each strip containing a row of images bearing corresponding identifying coded data thereon.

3. The method according to claim 1, characterized in step (4) by placing the end of an instrument of a size corresponding to the size of each said portion into contact with each said portion to be secured and pressing the surface of each said portion having the adhesive substance against the surface of the article.

4. The method according to claim 1, characterized by placing said portion in a container, embedding said container and portion in an opening in said article, and covering the remainder of said opening not occupied by said container.

5. The method according to claim 4, further characterized by subsequently locating said portion by uncovering said container, and magnifying said coded data on said portion in said container in order to identify said article.

6. The method according to claim 5 characterized by covering the remainder of said opening with a concealing substance matching the composition of the material to which said portion is secured.

7. The method of identifying the owner of an article in the event of subsequent loss or theft of said article comprising the steps of:

(1) forming a photographically duced image of identifying coded data which identifies the owner of the article;

(2) microprinting a series of said images on a sheet of transparent microfilm;

(3) applying an adhesive substance and backing member to a surface of said sheet;

(4) at least partially severing a portion of said sheet containing each of said images from said sheet without severing said backing member so that said images remain intact with said sheet on said backing member;

(5) severing said sheet into a plurality of rows, each row containing a plurality of said images thereon;

(6) removing said backing member at least partially from a row of said sheet to expose one or more of said portions and pressing each said portion so exposed against the surface of the article to be identified while separating said row from each said portion;

(7) recording the location of each image applied to the article for subsequent identification in the event of loss; and (8) magnifying at least one of said images on said article and matching with the recorded data identifying the owner of said article.

8. The method according to claim 7, in which step (6) is further characterized by placing each said strip in a container, embedding said container and strip in an opening formed in said article, and covering the remainder of said opening not occupied by said container with a material substantially corresponding to the composition of said equipment, subsequently removing said material covering said container when desired to identify the owner of said article, and magnifying said coded data on said strip to identify the owner of said article.

9. Apparatus for identifying the owner of an article in the event of loss of the article, comprising:

a transparent sheet of microfilm having a series of images in the form of microsized disks, each disk having owner-identifying, coded data imprinted on one surface thereof in photographically reduced form discernible only by magnification of said disk, each said disk being at least partially severed from but in the plane of said sheet; and securing means for removably securing each said disk to an article to be identified, said securing means defined by an adhesive on one surface of said sheet to be secured to said article.

10. Apparatus according to claim 9, each said disk being several mils thick and of a diameter of 5/64", said coded data being photographically reduced and imprinted on said disk.

* * * * *